United States Patent [19]

Laferty, Jr. et al.

[11] 4,028,095

[45] June 7, 1977

[54] FREE FLOWING POWDER AND PROCESS FOR PRODUCING IT

[75] Inventors: John M. Laferty, Jr., Wheat Ridge, Colo.; Joseph E. Ritsko, Towanda; David J. Port, Athens, both of Pa.

[73] Assignee: GTE Sylvania Incorporated, Stamford, Conn.

[22] Filed: Mar. 31, 1976

[21] Appl. No.: 672,502

Related U.S. Application Data

[60] Division of Ser. No. 594,734, July 10, 1975, Pat. No. 3,973,948, and a continuation-in-part of Ser. No. 414,976, Nov. 12, 1973, abandoned.

[52] U.S. Cl. ..... 75/.5 AB; 75/212

[51] Int. Cl.[2] ..... C22C 1/04

[58] Field of Search ..... 75/.5 BB, .5 AB, .5 BC, 75/.5 AC, .5 B, 212, .5 DC; 427/215, 216, 423; 428/403

[56] References Cited

UNITED STATES PATENTS

| | | | |
|---|---|---|---|
| 2,666,696 | 1/1954 | Fredenburgh | 75/.5 BB |
| 3,153,585 | 10/1964 | Laferty | 75/.5 BB |
| 3,223,523 | 12/1965 | Adler | 75/212 |
| 3,322,515 | 5/1967 | Dittrich et al. | 106/1 |
| 3,436,248 | 4/1969 | Dittrich et al. | 427/423 |
| 3,617,358 | 11/1971 | Dittrich | 75/.5 B |
| 3,890,137 | 6/1975 | Beyer et al. | 75/.5 BB |

*Primary Examiner*—Michael R. Lusignan
*Assistant Examiner*—S. Silverberg
*Attorney, Agent, or Firm*—Norman J. O'Malley; John C. Fox; Donald R. Castle

[57] ABSTRACT

Free flowing powders, such as for flame spray applications, are produced by spray drying a slurry of finely divided particles of the metal in a solvent-binder system to produce agglomerates, wherein the binder is a soluble compound of the metal. These agglomerates possess sufficient green strength to be screened and exhibit higher apparent densities than comparable powders agglomerated with conventional organic binders. When these powders are heated in a reducing atmosphere above the decomposition temperature of the binder, the binder converts to base metal and harmless by-products, such as nitrogen and water thus avoiding contamination of the product, equipment and work area usually associated with conventional organic binders.

7 Claims, No Drawings

FREE FLOWING POWDER AND PROCESS FOR PRODUCING IT

CROSS REFERENCE TO RELATED APPLICATION

This application is a division of Ser. No. 594,734 filed July 10, 1975 now U.S. Pat. No. 3,973,948 and assigned to the assignee of the present invention. Assignment recorded July 10, 1975, Reel 3214 Frame 192. Ser. No. 594,734 is a Continuation-in-Part of Ser. No. 414,976 filed Nov. 12, 1973, which was abandoned as of Aug. 8, 1975.

BACKGROUND OF THE INVENTION

FIELD OF THE INVENTION

This invention relates to free flowing powders and to an improved method for producing them from finely divided particulate material.

Free flowing powders for flame spraying have been made by various agglomeration methods which make free flowing powders of normally non-flowing small-diameter powder particles. These methods usually involve the use of an organic binder which causes many small particles to stick together resulting in agglomerates of larger size and relatively lower surface area and consequently have improved flow properties.

One of the more sophisticated agglomeration methods used for some time in the pharmaceutical and food industries utilizes spray drying. Agglomerates are formed in spray drying by atomizing a slurry of powder, binder and liquid into a drying chamber where the liquid is evaporated. The result is a generally spherical agglomerate held together by the binder.

Spray drying has been used in the production of flame spray powders. See U.S. Pat. No. 3,617,358, issued Nov. 2, 1971. This patented procedure as well as other methods of agglomeration do produce free flowing powders, however, not without some undesirable characteristics, most of which are related to the presence of the organic binder.

An organic binder has little other beneficial contribution than the ability to hold the particles together. Powder with organic material present does not work well in commercially available flame spray equipment. In many cases the binder is not strong enough to withstand handling and feeding. If strong enough for production use it vaporizes in the flame causing smoke and will condense in cooler areas, causing plugging or fouling of the gun, workpiece or work area.

It has been suggested and tried to remove the binder by various firing conditions. This procedure will result in powder without the organic material but not often without some trace of contamination.

Another difficulty with the binder is that it occupies space which powder could otherwise occupy and in this way holds these powders to relatively low apparent densities.

SUMMARY OF THE INVENTION

In accordance with the invention, it has been found that the binder related deficiencies of contamination, low agglomerate strength and low apparent density can be substantially overcome by using a soluble compound of a desired metallic constituent of the final agglomerated product as the binder, which upon heating in a reducing atmosphere (above the volatilization temperature of the solvent) decomposes to the base metal and at least one volatile product. The solvent-binder system when slurried with finely divided particles and dried as in spray drying produces particle agglomerates whose subparticles are bound together by the compound with sufficient green strength to be screened to obtain a desired size distribution, and exhibit higher apparent densities than comparable powders agglomerated with conventional organic binders.

The dried powders referred to as being in the green state are normally subjected to a heat treatment in a reducing atmosphere above the binder decomposition temperature in order to convert the binder to base metal and volatile products, and also to strengthen and densify the powder agglomerates. The powders also may be subjected to one or more additional heat treatments, either above or below the binder decomposition temperature, prior to their use in any of the above applications, for purposes of further strengthening or densification of the powder agglomerates.

The free flowing powders of the invention are useful in coating applications, such as flame spray applications, as brazing alloy powders, in the formation of powder compacts and other applications where flowability and lack of binder contamination are important considerations.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

As the starting finely divided material utilized in the formation of the slurry, any inorganic material having a melting point above 500° C, including elemental metals, alloys, pure or mixed oxides, borides, carbides, nitrides, etc., cermets, or mixed systems of the foregoing. Certain components of the final agglomerated product may be partially or totally introduced as the decomposition product of the binder.

Of particular interest for coating applications are refractory materials including the refractory metals W, Mo, Cr, Ta and Nb and their alloys, and any of the borides, carbides and nitrides with or without any of the various modifying additives known or used commercially to enhance one or more properties of these materials. Exemplary of such modified materials are the cemented tungsten carbides containing up to 30 percent cobalt.

For purposes of the invention, the term finely divided particles refers to particles exhibiting poor flowability, generally of particle sizes below 20 micrometers, but sometimes below 50 micrometers.

These particles are mechanically mixed with a liquid which is a solution of the binder in a suitable solvent to form a slurry to be spray dried. Since the solvent is to be evaporated during spray drying, it should have a volatilization temperature below the decomposition temperature of the binder. With water as the solvent suitable binders include, but are not limited to, ammonium complexes of metals or oxides, and metal nitrates and acetates. To aid the practitioner, some examples of suitable particle-solvent-binder systems are presented.

Where molybdenum or its alloys comprise the particulate material to be agglomerated, a suitable solvent-binder system would be water and ammonium molybdate. Upon spray drying, the free water is driven off, leaving molybdenum or molybdenum alloy particle agglomerates bound together by spray dried ammonium molybdate. As used herein, the term "spray dried ammonium molybdate" and "spray dried ammonium tungstate" refer to the spray dried product of the aqueous solution of the ammonium complex, since normal ammonium complexes of these metals are not known to exist in solid form. Upon heating in a reducing atmosphere, the compound decomposes around 1000° C to Mo, ammonia and water. Other examples of suitable aqueous slurry systems and the respective binder decomposition products and approximate decomposition temperatures are shown in Table I.

TABLE I

| Particles | ≠ Binder | Under Reducing Conditions Binder Decomposes to | Approx. Decomposition Temp. ° C. |
|---|---|---|---|
| Mo | AT, AMT | W, $NH_3$, $H_2O$ | 800–1000 |
| Mo—15*W | AM | Mo, $NH_3$, $H_2O$ | 800–1000 |
| Mo—15W | AT, AMT | W, $NH_3$, $H_2O$ | 800–1000 |
| W | AT, AMT | W, $NH_3$, $H_2O$ | 800–1000 |
| WC | Ammonium Complex of CoO | Co, $NH_3$, $H_2O$ | 800–1000 |
| WC—12*Co | Ammonium Complex of CoO | Co, $NH_3$, $H_2O$ | 800–1000 |
| WC | Cobalt Nitrate | Co, $NO_x$ | |
| WC | Cobalt Acetate | Co, $CO_2$ | |

*weight percent
≠ AM — ammonium molybdate
AT — ammonium tungstate
AMT — ammonium metatungstate The particular conditions under which the slurries are formed and spray dried are well known, and are not a necessary part of this description. A detailed description thereof may be found, for example, in U.S. Pat. No. 3,617,358, issued Nov. 2, 1971.

Depending upon the application envisioned, the spray dried agglomerates may be classified, usually by screening, in order to obtain a desired particle size distribution, for example, within about 60 micrometers and preferably 80 percent within 30 micrometers for flame spraying applications. It has been found that the spray dried powders of the invention normally possess sufficient green strength to withstand handling and classifying. However, it may be desired as optional steps to heat treat the agglomerates either above or below the binder decomposition temperature for purposes such as further strengthening or densification. Of course, such treatments should be carried out under conditions to prevent formation of an unusable mass by substantial diffusion bonding of the agglomerates to one another.

EXAMPLE

Four slurries are prepared by first dissolving appropriate quantities of $MoO_3$ in 28 percent $NH_4OH$ solutions to form ammonium molybdate solutions. These solutions are then diluted with water to obtain about 2.5 gallons each. The four solutions contain equivalent amounts of 5.9, 11.2, 11.2 and 20 percent $MoO_3$, respectively on a weight percent solids basis. To the third solution is added 0.45 percent of a polyethylene glycol binder (commercially available under the Tradename Carbowax 6000), and 0.175 percent stearic acid, on a weight percent solids basis. Forty pounds of molybdenum powder having a particle size of less than 10 micrometers are then added to each solution and the solutions mixed to form a slurry. The slurries are all spray dried under identical conditions, i.e., the solutions under continuous agitation are fed into one inlet of a two fluid nozzle at the top of a spray drying chamber, while air is fed into the other inlet at a pressure of about 37 psi. The drying air enters the chamber at a temperature of about 230° C and exits at about 130° C. The unagglomerated particles, so-called cyclone fines, are held for recycling, while the chamber products are subjected to a standard sieve analysis. The products are then presintered at 1000° C for 4 hours in $H_2$ to convert the binder to Mo and evaluated by sieve analysis, apparent density and Hall Flow measurements in order to investigate strengthening and densification. The products are then sintered at 1060° C for 4.5 hours in $H_2$ and evaluated as at presintering. Results are shown in Table II. Also shown in the Table are comparative results for the same molybdenum powder processed with the organic binders used in Lot No. 3, labeled Prior Art.

TABLE II

| Lot No. | 1 | 2 | 3 | 4 | Prior Art |
|---|---|---|---|---|---|
| $MoO_3$ (weight percent solids) | 5.9 | 11.2 | 11.2 with binder | 20 | 0 |
| **SPRAY DRIED (GREEN) PROPERTIES** | | | | | |
| Sieve Analysis | Percent Retained | | | | |
| +100 mesh | 4% | 8 | 6 | 28 | 9 |
| +200 | 30 | 36 | 24 | 42 | 31 |
| +325 | 32 | 30 | 27 | 17 | 28 |
| −325 | 34 | 26 | 42 | 13 | 32 |
| Apparent Density g/cc | 2.20 | 2.26 | 2.30 | 2.26 | 1.95 |
| **PRESINTERED PROPERTIES** | | | | | |
| Sieve Analysis | Percent Retained | | | | |
| +60 | 1 | 1 | 1 | 5 | 9 |
| +200 | 31 | 39 | 29 | 62 | 32 |
| +325 | 43 | 40 | 44 | 23 | 25 |
| −325 | 25 | 20 | 26 | 10 | 34 |
| Apparent Density g/cc | 2.26 | 2.26 | 2.20 | 2.32 | — |
| Hall Flow, Sec. | 37 | 35 | 39 | 33 | — |
| **SINTERED PROPERTIES** | | | | | |
| Sieve Analysis | Percent Retained | | | | |
| +60 | — | — | — | — | 8 |
| +200 | 34 | 43 | 33 | 53 | 33 |
| +325 | 36 | 36 | 37 | 31 | 27 |
| −325 | 30 | 21 | 30 | 16 | 32 |
| Apparent Density g/cc | 2.26 | 2.26 | 2.20 | 2.38 | 1.97 |
| Hall Flow, Sec. | 33 | 35 | 37 | 32 | 45 |

The results indicate that the apparent density of the inventive product is substantially higher than that of the prior art product, both after spray drying and after sintering. That is, of course, advantageous, in that the volume of material to be handled is reduced and processing time is decreased. The flow properties, as indicated by Hall Flow measurements, of the sintered product are also improved over that of the prior art product subjected to identical pre-sintering and sintering conditions. It will be seen that Lot No. 3, which includes a portion of organic binder, also exhibits improved density and flow properties. Thus, while it is contemplated that the binder will normally not include organic or other conventional binders, the presence of such binders, up to 50 percent of the total binder content, is contemplated as being within the scope of the invention.

While there has been shown and described what is at present considered the preferred embodiment of the invention, it will be obvious to those skilled in the art that various changes and modifications may be made therein without departing from the scope of the invention as defined by the appended claims.

What is claimed is:

1. Process for producing a free flowing powder from finely divided particles of an inorganic material having a melting point about 500° C, the process comprising producing agglomerates of the particulate material by spray drying a slurry of the material in a liquid, the liquid comprising a solution of binder in a volatile solvent, characterized in that at least 50 percent by weight of the binder consists essentially of at least one water soluble metallic ammonium complex of an element selected from the group consisting of molybdenum and tungsten whereby upon heating in a reducing atmosphere the ammonium complex decomposes to base metal and at least one volatile product.

2. Process of claim 1 in which the metallic constituent of the metallic compound is the same as a metallic constituent of the particles.

3. Process of claim 2 in which the particulate material consists essentially of molybdenum, and the metallic complex is ammonium molybdate.

4. Process of claim 2 in which the particulate material consists essentially of tungsten and the metallic complex is selected from the group consisting of ammonium metatungstate and ammonium tungstate.

5. Process of claim 2 in which the particulate material consists essentially of any alloy of molybdenum containing up to 15 weight percent tungsten and the metallic complex is selected from the group consisting of ammonium molybdate, ammonium metatungstate and ammonium tungstate.

6. Process of claim 1 in which the spray dried agglomerates are classified according to size.

7. Process of claim 1 in which the spray dried agglomerates are heated in a reducing atmosphere to decompose the metallic complex.

* * * * *